US007610963B2

(12) United States Patent
Unsgaard et al.

(10) Patent No.: US 7,610,963 B2
(45) Date of Patent: Nov. 3, 2009

(54) METHOD AND DEVICE FOR FLUID DISPLACEMENT

(75) Inventors: Tom Unsgaard, Stavanger (NO); Steffen Eversen, Stavanger (NO)

(73) Assignee: HPI AS, Tananger (NO)

( * ) Notice: Subject to any disclaimer, the term of this patent is extended or adjusted under 35 U.S.C. 154(b) by 0 days.

(21) Appl. No.: 11/666,791

(22) PCT Filed: Oct. 26, 2005

(86) PCT No.: PCT/NO2005/000406

§ 371 (c)(1),
(2), (4) Date: Aug. 27, 2007

(87) PCT Pub. No.: WO2006/052139

PCT Pub. Date: May 18, 2006

(65) Prior Publication Data

US 2008/0173446 A1 Jul. 24, 2008

(30) Foreign Application Priority Data

Nov. 1, 2004 (NO) ..... 20044711

(51) Int. Cl.
*E21B 33/16* (2006.01)

(52) U.S. Cl. ..... 166/291; 166/177.4; 166/187

(58) Field of Classification Search ..... 166/291, 166/285, 177.4, 187
See application file for complete search history.

(56) References Cited

U.S. PATENT DOCUMENTS

| | | | | | |
|---|---|---|---|---|---|
| 2,828,823 | A | | 4/1958 | Mounce | |
| 3,524,503 | A | * | 8/1970 | Baker | 166/289 |
| 3,948,322 | A | * | 4/1976 | Baker | 166/289 |
| RE29,830 | E | * | 11/1978 | Scott | 166/155 |
| 4,155,404 | A | * | 5/1979 | Hollingsworth | 166/285 |
| 4,782,892 | A | * | 11/1988 | Ostbo | 165/164 |
| 5,526,878 | A | | 6/1996 | Duell et al. | |
| 5,718,288 | A | | 2/1998 | Bertet et al. | |
| 5,738,171 | A | | 4/1998 | Szarka | |
| 6,044,906 | A | | 4/2000 | Saltel | |

FOREIGN PATENT DOCUMENTS

| | | |
|---|---|---|
| CA | 1209470 | 8/1986 |
| GB | 2320734 | 7/1998 |
| SU | 740935 | 6/1980 |
| WO | WO 91/19882 | 12/1991 |

* cited by examiner

*Primary Examiner*—Hoang Dang
(74) *Attorney, Agent, or Firm*—Patents & TMS, P.C.

(57) ABSTRACT

A method and device for displacement of a first fluid by means of a second fluid in a borehole (1) in the ground, where, during displacement, the second fluid is kept separate from the first fluid, and where the volume of an expandable space (22) in which the second fluid is to be located following the displacement, increases during inflow of the second fluid.

20 Claims, 4 Drawing Sheets

METHOD AND DEVICE FOR FLUID DISPLACEMENT

This invention regards a method of fluid displacement. More particularly, it regards a method of fluid displacement in a borehole in the ground, where a fluid, typically a drill fluid or well fluid, in part of the well bore is to be replaced by another fluid such as e.g. cement. The invention also regards a device for implementing the method.

In this context, fluid refers to any form of liquid or pumpable material such as petroleum, drill fluid, cement, concrete or resin coated sand.

The following is based on cementing operations in a borehole in the ground, as the challenges that arise in connection with such cementing operations represent to a satisfactory degree those conditions that occur when performing controlled displacement of a fluid from a defined area of e.g. a well.

Cementing operations in a borehole in the ground may include casting of a plug in a lined or unlined portion of the well in order to e.g. drill a new borehole that deviates from a first borehole, or to set a concrete plug in order to hydraulically isolate one well section from another.

According to prior art, such operations require that a relatively large quantity of cement be pumped into the well, preferably simultaneously with the retraction of the pump pipe. The pump pipe may be a drill pipe or coiled tubing.

When applying prior art, it is often uncertain whether the degree to which the wellbore has been filled with concrete or cement is sufficient. Often, the fluid located in part of e.g. a horizontal wellbore will not be completely displaced when the wellbore is cemented. Typically, the concrete fills most of the cross section of the hole, while there is an opening above the concrete caused by insufficient displacement of the well fluid.

In a vertical bore there is a tendency for part of the concrete to sink, thus changing places with other fluids in the borehole. Consequently a concrete plug in a vertical borehole will often include several relatively porous and possibly also discontinuous plug sections.

The object of the invention is to remedy or reduce at least one of the disadvantages of prior art.

The object is achieved in accordance with the invention, by the characteristics stated in the description below and in the following claims.

The method of displacing a first fluid by means of a second fluid in a borehole in the ground is implemented through the second fluid, during displacement, being kept generally separate from the first fluid, with the volume of an expandable space in which the second fluid is to be located following displacement, increasing during the inflow of the second fluid.

Typically the expandable space is in an annulus between the formation wall of a well and a feed pipe. Thus the expandable space is defined by at least one membrane and the feed pipe, the membrane placing itself out against the formation wall during the outflow of fluid.

In this context the term membrane refers to an impermeable or semi-permeable material. The second fluid may be mixed with fluid arranged for complete or partial passage through the membrane.

Alternatively the expandable space is defined by a liner in the borehole together with said membranes and the feed pipe.

In a preferred embodiment, the end of the feed pipe projecting into the borehole is surrounded by a first fixed and a second movable piston body. The piston bodies are provided with flow orifices longitudinally of the feed pipe, the flow orifices allowing fluid to flow past the bodies during the displacement of the feed pipe in the well and during circulation through the feed pipe.

The piston bodies have packing-like membranes that enclose the feed pipe, and which remain in a collapsed, inactive position while the feed pipe is moving in the well.

When the second fluid is made to flow in between the two piston bodies, the membranes are released, thereby sealing the liner or the well wall. Upon further inflow of the second fluid between the piston-like bodies the second piston body is displaced along the feed pipe while the piston body displaces the first fluid.

Advantageously the second piston body is provided with a cleansing device such as a scraper that removes impurities from the liner during the displacement along the feed pipe.

In an alternative embodiment a membrane may be arranged so as to enclose the feed pipe as this is moved into the well, the membrane being arranged to place itself out against the formation wall when filled with the second fluid.

Typically, a desired amount of the second fluid is introduced in a pump pipe that communicates with the feed pipe. The second fluid is displaced down to the feed pipe behind a displaceable first valve body that seals against the pump pipe and the feed pipe. The first valve body is arranged to seal against a first valve seat in the feed pipe.

A second valve body, which seals against the pump pipe, is displaced behind the desired amount of the second fluid, which second valve body is arranged to seal against a second valve seat. The second valve seat is typically located at the end of the feed pipe facing the pump pipe.

The second fluid is pumped into the expandable space via feed orifices in the pipe wall of the feed pipe after the first valve body has closed off the first valve seat.

After the desired amount of the second fluid has flowed into the expandable space, the second valve body comes to a sealing stop against the second valve seat.

Increasing the pressure in the pump pipe can detach the feed pipe from the pump pipe. Thus the feed pipe can be left behind in the borehole, where, still filled with the second fluid, it forms part of a concrete plug in the borehole when the second fluid is concrete.

The method of the invention can also be adapted for use with coiled tubing, as the first and second valve bodies may be situated in the feed pipe during the transport into the borehole, whereupon they are actuated and brought to seal upon a signal from the surface. Alternatively, the cement may be contained in a receptacle between the coiled tubing and the feed pipe during the transport into the borehole.

In an embodiment adapted for use during wireline operations, the feed pipe also comprises the required actuators for pumping the second fluid into the expandable space. In this embodiment the method of the invention is also suitable for use with a well tractor.

The following describes a non-limiting example of a preferred embodiment illustrated in the accompanying drawings, in which.

Figure 1:
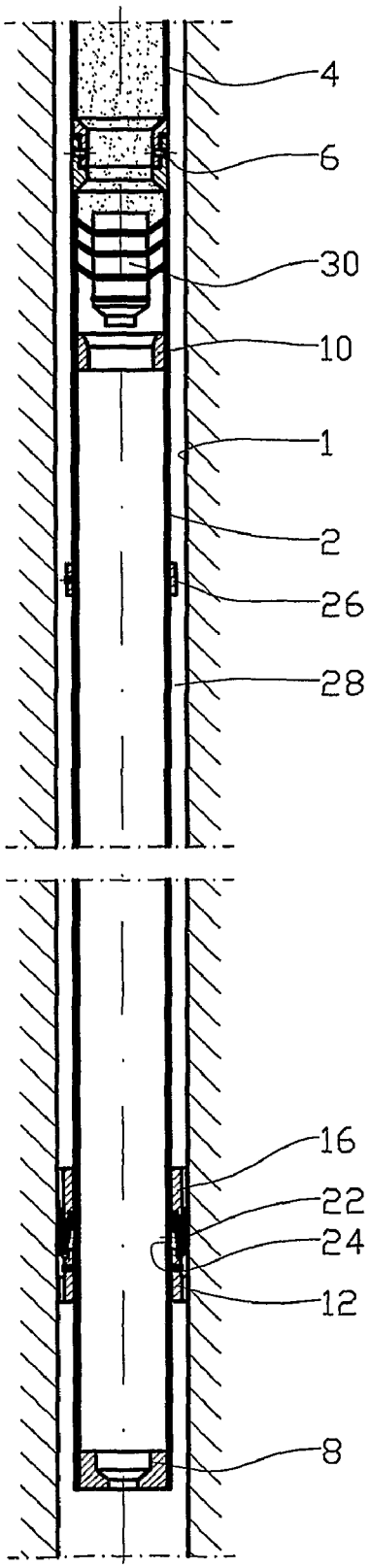
FIG. 1 shows a device for fluid displacement according to the invention, in which a first valve body followed by a second fluid is underway into a feed pipe.

In the drawings, reference numeral 1 denotes an unlined borehole in the ground, in which is placed a feed pipe 2. The borehole 1 might as well be lined. In the drawings, the borehole is shown as vertical, however the method and device of the invention are just as suitable for boreholes that are oriented at an angle to the vertical.

The feed pipe 2 communicates with a pump pipe 4 and is releasably coupled to the pump pipe 4 by shear pins 6. In this embodiment, the pump pipe 4 extends up to the surface.

The feed pipe 2 is provided with a valve seat 8 at the end portion facing into the borehole 1 and with a second valve seat 10 at the opposite end portion. The flow orifice of the second valve seat 10 has a greater diameter than that of the flow orifice of the first valve seat 8.

Figure 5:
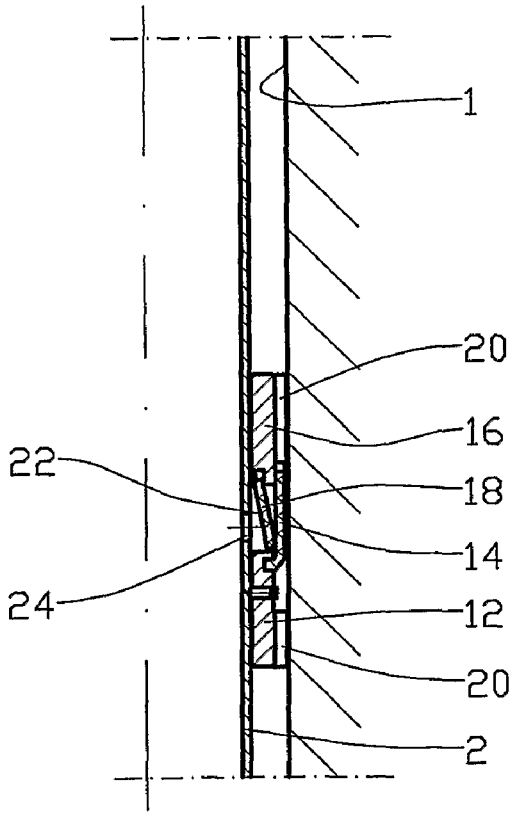
FIG. 5 shows a section of FIG. 1, on a larger scale.

Surrounding the feed pipe 2 there is provided a first fixed piston body 12 provided with a first membrane 14, see FIG. 5. A second, longitudinally of the feed pipe 2 displaceable piston body 16 is provided with a second membrane 18. The membranes 14, 18 face each other and are in the inactive position, when e.g. the feed pipe 2 is being displaced in the borehole 1, retracted from the borehole 1 wall.

Figure 6:
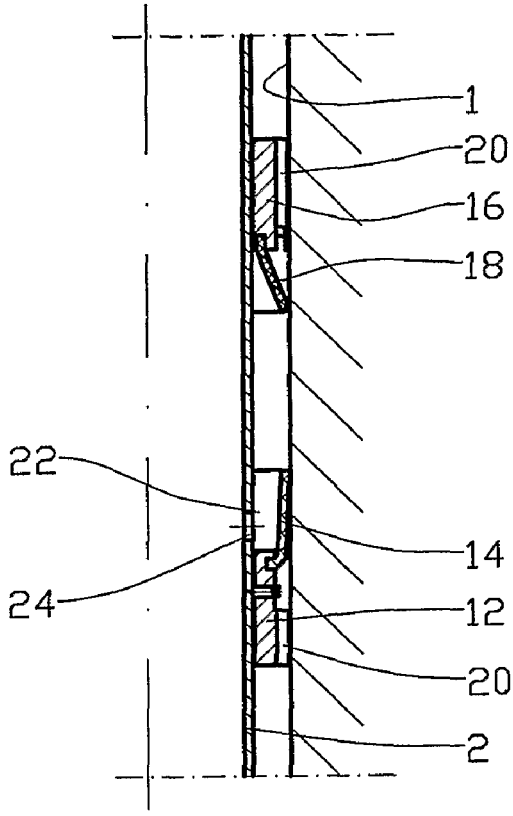
FIG. 6 shows a section of FIG. 2, on a larger scale.

The membranes 14 and 18 are arranged to sealingly about the wall of the borehole 1 when in the active position, see FIG. 6.

The piston bodies 12 and 16 are provided with flow orifices 20 through which the first fluid may flow when the feed pipe 2 is being displaced in the borehole 1 and during circulation of fluids in the borehole 1.

The space between the two membranes 14 and 18 forms an expandable space 22, the space communicating with the feed pipe 2 via an inlet orifice 24 in the wall of the feed pipe 2. The inlet orifice 24 is located between the valve seats 8 and 10.

A stop ring 26 arranged to restrict the travel of the second piston body 16 along the feed pipe 2 is rigidly mounted to and encloses the feed pipe 2.

When the first fluid is to be displaced from an annulus 28 formed between the borehole 1 and the feed pipe 2, a first valve body 30 is moved into the pump pipe 4 and on into the feed pipe 2. The first valve body 30 seals against the pipe walls of the pump pipe 4 and the feed pipe 2 and is arranged to be sealingly placed in the first valve seat 8. The first valve body 30 is dimensioned so as to allow it to pass through the second valve seat 10.

A predetermined quantity of the second fluid is introduced immediately behind the first valve body 30. In the drawings the second fluid is illustrated by dots.

Following the second fluid a second valve body 32 is displaced in the pump pipe 4 and into the feed pipe 2. The second valve body 32 also seals against the respective pipe walls and is arranged to be sealingly placed in the second valve seat 10.

The two valve bodies 30 and 32 are circulated into the pump pipe 4 and on into the feed pipe 2 along with the fluid located between the valve bodies, see FIG. 1.

Figure 2:
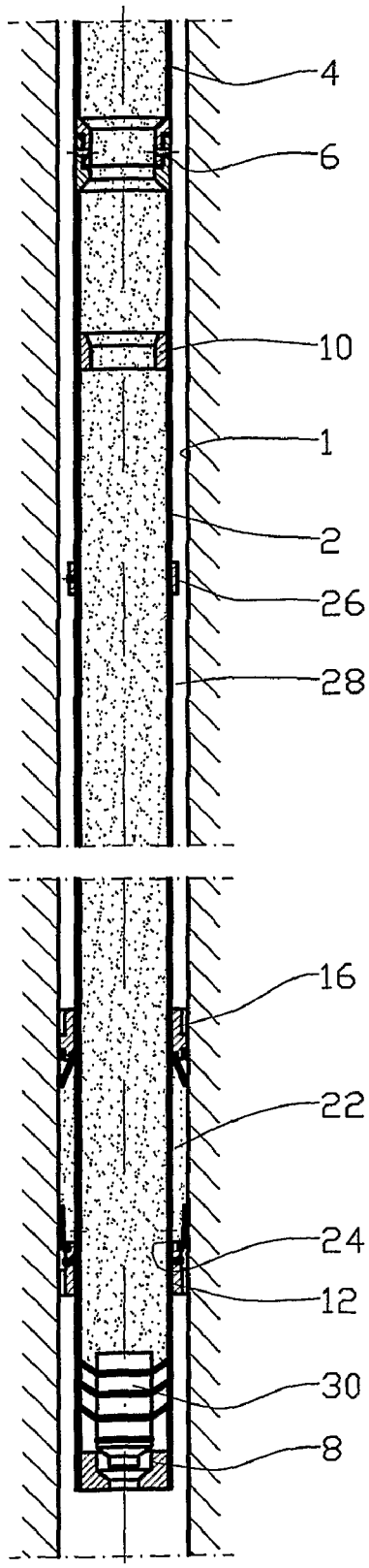
FIG. 2 shows the device of FIG. 1 after the first valve body is sealingly arranged in a first valve seat and a portion of the second fluid has flowed into an expandable space, a second piston body being displaced in an annulus between the feed pipe and the borehole wall.
Figure 3:
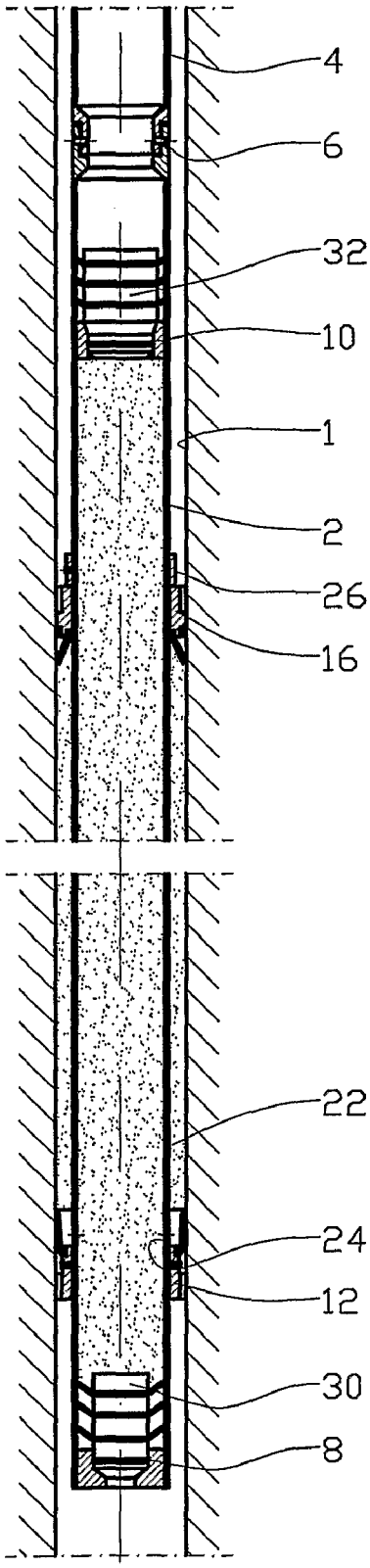
FIG. 3 shows the same as FIG. 2, but here the fluid displacement has been carried out, a second valve body being sealingly arranged in a second valve seat.
Figure 4:
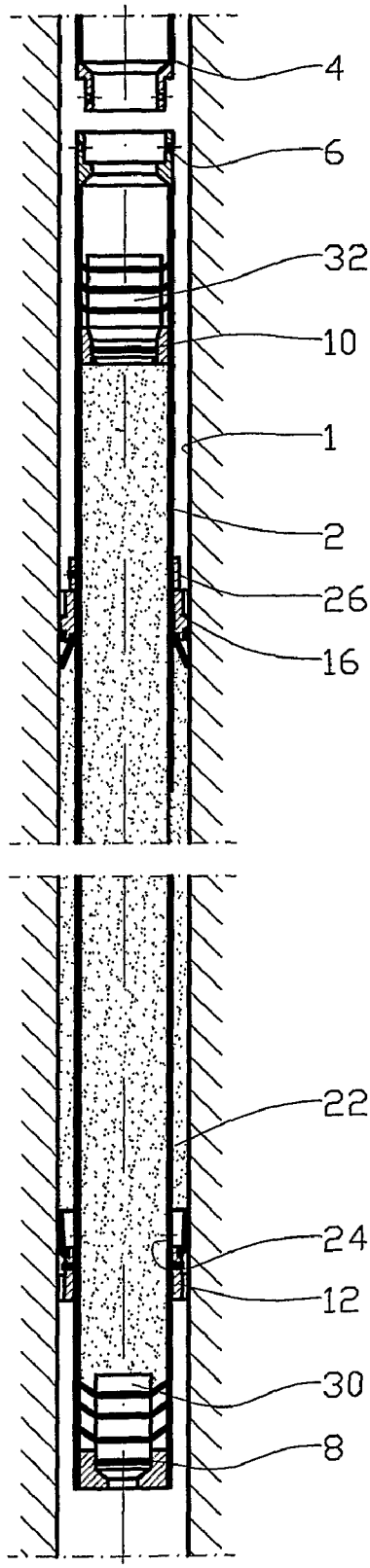
FIG. 4 shows the device after the pump pipe has been detached from the feed pipe.

When the first valve body 30 stops against the first valve seat 8 the second fluid flows through outlet orifices 24 and into the expandable space 22. With this, the second piston body 18 is displaced along the feed pipe 2, with the first and second membranes 14 and 18 placing themselves out against the borehole 1 wall in a sealing manner. The first piston body 12 is connected to the feed pipe 2 and remains at rest. See FIGS. 2 and 6. The second fluid continues to flow into the expandable space 22 until the second valve body 32 stops against the second valve seat 10, see FIG. 3.

A further increase of the pressure in the pump pipe 4 will shear the shear pins 6, whereby the pump pipe 4 is detached from the feed pipe 2.

During its displacement along the feed pipe 2 the second membrane 18 has displaced the first fluid from the corresponding portion of the annulus 28. Thus the second fluid located in the annulus 28 and in the feed pipe 2 forms a uniform column that, if the second fluid is concrete, provides a concrete plug, which completely fills a length of the borehole 1.

Figure 7:
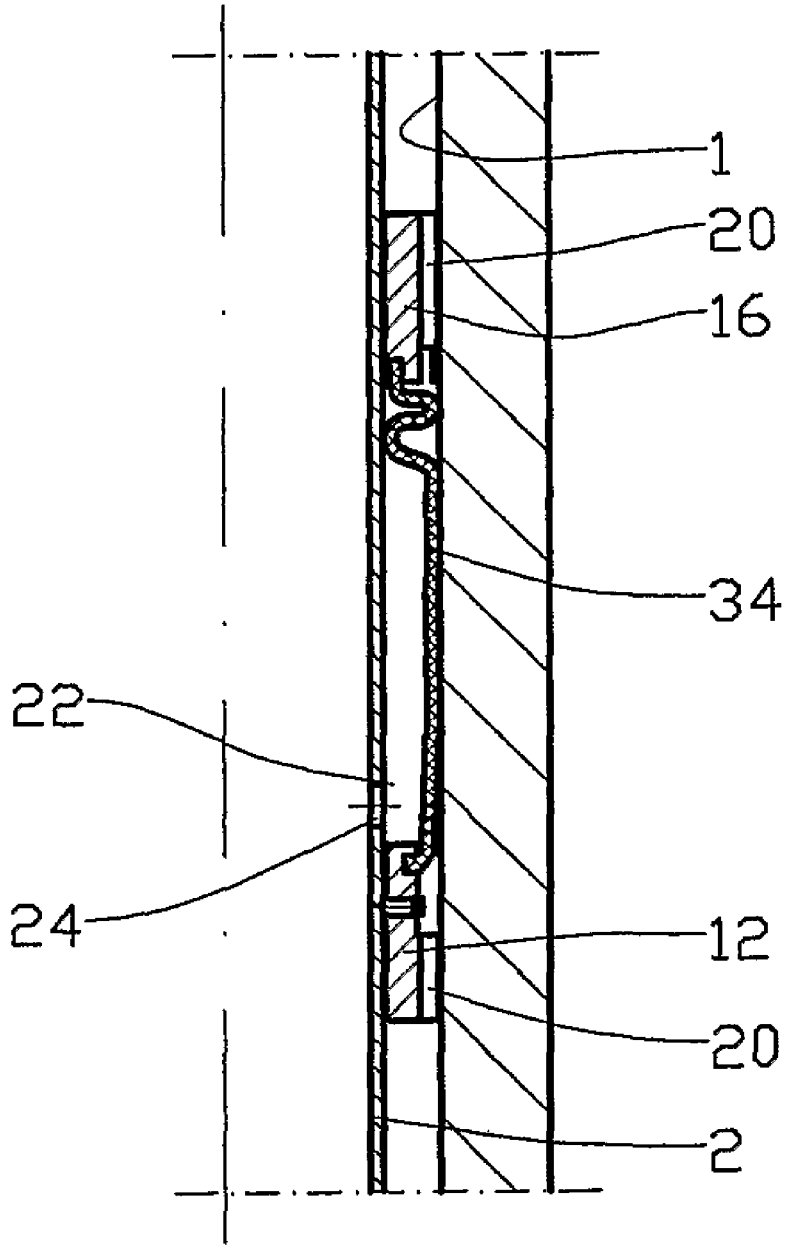
FIG. 7 shows a scaled-up alternative embodiment in which a hose-shaped membrane encloses the feed pipe.

In an alternative embodiment, see FIG. 7, the piston bodies 12 and 16 are interconnected by an elongated hose-shaped membrane 34. In the course of the filling, the second fluid forces the hose-shaped membrane 34 up against the wall of the borehole 1. When the second piston body 16 stops against the stop ring 26 the pressure between the piston bodies may be increased further.

In a further embodiment (not shown) the hose-shaped membrane 34 may be fixed to the feed pipe 2 by both ends.

The invention claimed is:

1. A method of displacing a first fluid by means of a second fluid in a borehole in a ground wherein a feed pipe is located in the borehole and further wherein the feed pipe is connected to a piston body that is located between the feed pipe and a wall of the borehole wherein the feed pipe has a length defined between a first end and a second end, the method comprising the steps of:

keeping the second fluid separate from the first fluid during a displacement;

displacing the second fluid into an expandable space wherein the expandable space is defined by a closed membrane connected to the piston body and the feed pipe wherein the expandable space expands during an inflow of the second fluid wherein the second fluid is located in the expandable space following the displacement; and moving the piston body in a direction toward the first end of the feed pipe wherein the inflow of the second fluid into the expandable space expands the expandable space and further wherein expansion of the expandable space moves the piston body.

2. The method of claim 1 further comprising the step of:

leaving the feed pipe in the borehole after a desired quantity of the second fluid is introduced into the expandable space.

3. The method of claim 1 further comprising the step of:

restricting movement of the piston body toward the first end of the feed pipe.

4. The method of claim 1 further comprising the step of:

displacing pins that connect the first end of the feed pipe to a pump pipe wherein the pump pipe has an interior having a pressure and further wherein the pins are displaced by an increase in the pressure in the interior of the pump pipe.

5. A device for displacement of a first fluid by a second fluid in a borehole in a ground wherein the borehole has a borehole wall, the device comprising:

a feed pipe located in the borehole;

a first valve body wherein the first valve body is displaced in a sealing manner in the feed pipe wherein the first valve body is arranged to seal against a first valve seat in the feed pipe;

a second valve body wherein the second valve body is displaced in a sealing manner in the feed pipe wherein the second valve body is arranged to seal against a second valve seat in the feed pipe;

a first orifice in the feed pipe wherein the first orifice is located between the first valve body and the second valve body and further wherein connection of the first valve body to the first valve seat directs the second fluid through the first orifice;

a piston body located between the feed pipe and the borehole wall; and a membrane connected to the piston body wherein flow of the second fluid through the orifice moves the piston body in a direction toward the first end of the feed pipe.

6. The device of claim 5 wherein the feed pipe is detachable from a pump pipe wherein the pump pipe is arranged to deliver the second fluid to the feed pipe.

7. The device of claim 5 further comprising:

a liner located in the borehole.

8. The device of claim 5 further comprising:

an additional membrane connected to an additional piston body located between the feed pipe and the borehole wall.

9. The device of claim 5 further comprising:

a ring connected to the feed pipe wherein the ring is located between the piston body and the first end of the feed pipe and further wherein the ring restricts movement of the piston body toward the first end of the feed pipe.

10. The device of claim 5 further comprising:

a second orifice wherein the second orifice is located in the piston body.

11. A system for displacement of a first fluid by a second fluid in a borehole having a wall, the device comprising:

a feed pipe located in the borehole wherein the feed pipe has a length defined by a bottom end and a top end and further wherein the feed pipe has a first orifice located between the top end and the bottom end;

a first valve seat connected to the feed pipe wherein the first valve seat is located adjacent to the bottom end of the feed pipe;

a second valve seat connected to the feed pipe wherein the second valve seat is located adjacent to the top end of the feed pipe and further wherein the first orifice is located between the first valve seat and the second valve seat;

a first piston body connected to the feed pipe wherein the first piston body surrounds the feed pipe and further wherein the first piston body is located between the feed pipe and the wall of the borehole;

a second piston body connected to the feed pipe wherein the second piston body surrounds the feed pipe and further wherein the second piston body is located between the feed pipe and the wall of the borehole wherein the second piston body is located above the first piston body;

a membrane connected to the second piston body; and an expandable space defined by the feed pipe and the membrane wherein introduction of the second fluid to the expandable space moves the second piston body in a direction toward the top end of the feed pipe.

12. The system of claim 11 further comprising:

an additional membrane wherein the expandable space is defined by the feed pipe, the membrane, the additional membrane and the wall of the borehole and further wherein the additional membrane is connected to the first piston body.

13. The system of claim 11 wherein the membrane is connected to the first piston body.

14. The system of claim 11 further comprising:

a second orifice and a third orifice wherein the second orifice is located in the first piston body and further wherein the third orifice is located in the second piston body wherein the first fluid flows through the second orifice and the third orifice.

15. The system of claim 11 further comprising:

a ring connected to the feed pipe wherein the ring is located above the second piston body and further wherein the ring restricts movement of the second piston body in a direction toward the top end of the feed pipe.

16. The system of claim 11 further comprising:

a valve body located in the interior of the feed pipe wherein connection of the valve body to the first valve seat seals the bottom end of the feed pipe.

17. The system of claim 11 further comprising:

a valve body located in the interior of the feed pipe wherein connection of the valve body to the second valve seat seals the top end of the feed pipe.

18. The system of claim 11 further comprising:

a first valve body and a second valve body located in the interior of the feed pipe wherein connection of the first valve body to the first valve seat seals the bottom end of the feed pipe and further wherein connection of the second valve body to the second valve seat seals the top end of the feed pipe.

19. The system of claim 11 further comprising:

pins that connect the feed pipe to a pump pipe located above the feed pipe.

20. The system of claim 11 wherein the first piston body is rigidly attached to the feed pipe wherein rigid attachment of the first piston body to the feed pipe prevents movement of the first piston body by expansion of the expandable space.

* * * * *